US005551899A

United States Patent [19]

Hatcher

[11] Patent Number: 5,551,899

[45] Date of Patent: Sep. 3, 1996

[54] ATTACHMENT FOR HAND CONTROL OF A FOOT OPERATED CONTROLLER FOR AN ELECTRIC TROLLING MOTOR

[76] Inventor: Jerry J. Hatcher, 622 N.C. Hwy. 111 South, Chinquapin, N.C. 28521

[21] Appl. No.: 436,004

[22] Filed: May 5, 1995

[51] Int. Cl.[6] ..... B60L 11/02

[52] U.S. Cl. ..... 440/6; 114/144 R

[58] Field of Search ..... 114/144 R, 144 B, 114/230; 440/6, 7; 74/481

[56] References Cited

U.S. PATENT DOCUMENTS

| | | | |
|---|---|---|---|
| 4,604,066 | 8/1986 | Davatz | 440/7 |
| 4,676,162 | 6/1987 | Chaiko | 114/230 |
| 4,698,032 | 10/1987 | Hill | 440/6 |

*Primary Examiner*—Jesus D. Sotelo

[57] ABSTRACT

An attachment for hand control of a foot operated controller for an electric trolling motor comprised of a tubular upper handle having a grasping handle secured orthogonally thereto. The grasping handle has a control mechanism on an upper portion thereof. The control mechanism has wiring extending downwardly therefrom outwardly of the upper handle. A tubular lower handle telescopically receives the tubular upper handle therein. The tubular lower handle has a securement portion integral with a lower portion thereof. The wire from the control mechanism of the upper tubular handle extends outwardly of the open second end. A U-shaped securement bracket is secured to a foot operated controller for an electric trolling motor. The wire from the control mechanism of the upper tubular handle extends through the bracket for electrical coupling with the foot operated controller. The U-shaped securement bracket is pivotally coupled to the securement portion of the lower handle to adjust the angle of the tubular lower handle in relationship to the U-shaped securement bracket and the foot operated controller.

1 Claim, 3 Drawing Sheets

ATTACHMENT FOR HAND CONTROL OF A FOOT OPERATED CONTROLLER FOR AN ELECTRIC TROLLING MOTOR

BACKGROUND OF THE INVENTION

1. Field of the Invention

The present invention relates to an attachment for hand control of a foot operated controller for an electric trolling motor and more particularly pertains to allowing a user to use their hands to control an electric trolling motor with an attachment for hand control of a foot operated controller for an electric trolling motor.

2. Description of the Prior Art

The use of controls for trolling motors is known in the prior art. More specifically, controls for trolling motors heretofore devised and utilized for the purpose of providing control means for trolling motors are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,119,688 to Snyder, Jr. discloses a portable device for the hand operation of a motor vehicle accelerator pedal.

U.S. Pat. No. 4,604,066 to Davatz discloses a hand control for foot control trolling motor.

U.S. Pat. No. 4,527,983 to Booth discloses a trolling control for boats.

U.S. Pat. No. 4,130,079 to Rhorer et al, discloses an auxiliary steering control for electric trolling motor.

U.S. Pat. No. 3,561,393 to Fortson discloses a control system for trolling motor.

U.S. Pat. No. 5,282,522 to Grindle discloses a multipurpose speed control apparatus.

While these devices fulfill their respective, particular objective and requirements, the aforementioned patents do not describe an attachment for hand control of a foot operated controller for an electric trolling motor for allowing a user to use their hands to control an electric trolling motor.

In this respect, the attachment for hand control of a foot operated controller for an electric trolling motor according to the present invention substantially departs from the conventional concepts and designs of the prior art, and in doing so provides an apparatus primarily developed for the purpose of allowing a user to use their hands to control an electric trolling motor.

Therefore, it can be appreciated that there exists a continuing need for new and improved attachment for hand control of a foot operated controller for an electric trolling motor which can be used for allowing a user to use their hands to control an electric trolling motor. In this regard, the present invention substantially fulfills this need.

SUMMARY OF THE INVENTION

In the view of the foregoing disadvantages inherent in the known types of controls for trolling motors now present in the prior art, the present invention provides an improved attachment for hand control of a foot operated controller for an electric trolling motor. As such, the general purpose of the present invention, which will be described subsequently in greater detail, is to provide a new and improved attachment for hand control of a foot operated controller for an electric trolling motor and method which has all the advantages of the prior art and none of the disadvantages.

To attain this, the present invention essentially comprises a tubular upper handle having an open first end and an open second end. The open first end has a grasping handle secured orthogonally thereto. The grasping handle has a control mechanism on an upper portion thereof. The control mechanism has wiring extending downwardly therefrom outwardly of the open second end. The next component is a tubular lower handle having an open first end and an open second end. The open first end has external threads thereon. The open first end telescopically receives the open second end of the tubular upper handle therein. The open first end has an adjustment nut thereon cooperating with the external threads thereof for adjustable securement of the tubular upper handle within the tubular lower handle. The open second end of the tubular lower handle has a securement portion integral therewith. The securement portion has an aperture formed horizontally therethrough. The securement portion has a plurality of female detent elements formed on a side thereof positioned in a semi-circular arrangement above the aperture formed therethrough. The wire from the control mechanism of the upper tubular handle extends outwardly of the open second end. The final component is a U-shaped securement bracket having a lower portion and two upper portions. The lower portion has an aperture formed therethrough. The lower portion is secured to a foot operated controller for an electric trolling motor. The wire from the control mechanism of the upper tubular handle extends through the aperture in the lower portion for electrical coupling with the foot operated controller. The U-shaped securement bracket receives the securement portion of the lower tubular handle between the two upper brackets and pivotally couples the securement portion to the two upper portions by a pivot pin extending through the two upper portions and the aperture formed horizontally through the securement portion. One of the two upper portions has a spring biased male detent element coupled thereto. The spring biased male detent element selectively cooperates with one of the plurality of female detent elements of the securement portion to adjust the angle of the tubular lower handle in relationship to the U-shaped securement bracket and the foot operated controller.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art Who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved attachment for hand control of a foot operated controller for an electric trolling motor which has all the advantages of the prior art controls for trolling motors and none of the disadvantages.

It is another object of the present invention to provide a new and improved attachment for hand control of a foot operated controller for an electric trolling motor which may be easily and efficiently manufactured and marketed.

It is a further object of the present invention to provide a new and improved attachment for hand control of a foot operated controller for an electric trolling motor which is of durable and reliable construction.

An even further object of the present invention is to provide a new and improved attachment for hand control of a foot operated controller for an electric trolling motor which is susceptible of a low cost of manufacture with regard to both materials and labor, and which accordingly is then susceptible of low prices of sale to the consuming public, thereby making such an attachment for hand control of a foot operated controller for an electric trolling motor economically available to the buying public.

Still yet another object of the present invention is to provide a new and improved attachment for hand control of a foot operated controller for an electric trolling motor which provides in the apparatuses and methods of the prior art some of the advantages thereof, while simultaneously overcoming some of the disadvantages normally associated therewith.

Even still another object of the present invention is to provide a new and improved attachment for hand control of a foot operated controller for an electric trolling motor for allowing a user to use their hands to control an electric trolling motor.

Lastly, it is an object of the present invention to provide a new and improved attachment for hand control of a foot operated controller for an electric trolling motor comprised of a tubular upper handle having a grasping handle secured orthogonally thereto. The grasping handle has a control mechanism on an upper portion thereof. The control mechanism has wiring extending downwardly therefrom outwardly of the upper handle. A tubular lower handle telescopically receives the tubular upper handle therein. The tubular lower handle has a securement portion integral with a lower portion thereof. The wire from the control mechanism of the upper tubular handle extends outwardly of the open second end. A U-shaped securement bracket is secured to a foot operated controller for an electric trolling motor. The wire from the control mechanism of the upper tubular handle extends through the bracket for electrical coupling with the foot operated controller. The U-shaped securement bracket is pivotally coupled to the securement portion of the lower handle to adjust the angle of the tubular lower handle in relationship to the U-shaped securement bracket and the foot operated controller.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
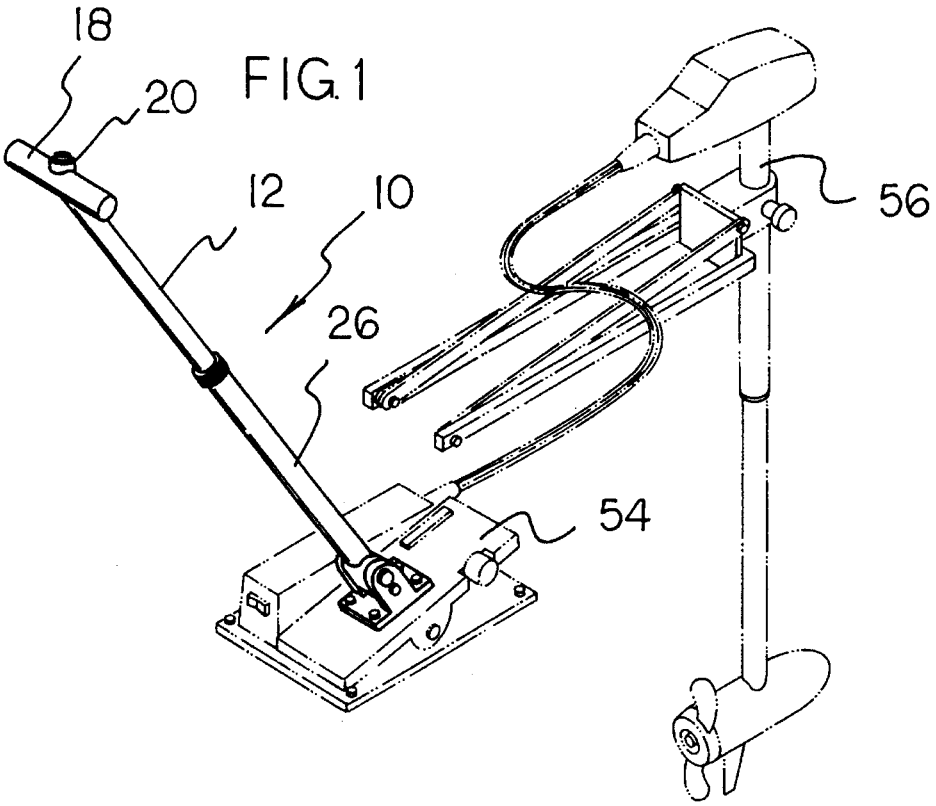
FIG. 1 is a perspective view of the preferred embodiment of the attachment for hand control of a foot operated controller for an electric trolling motor constructed in accordance with the principles of the present invention.
Figure 2:
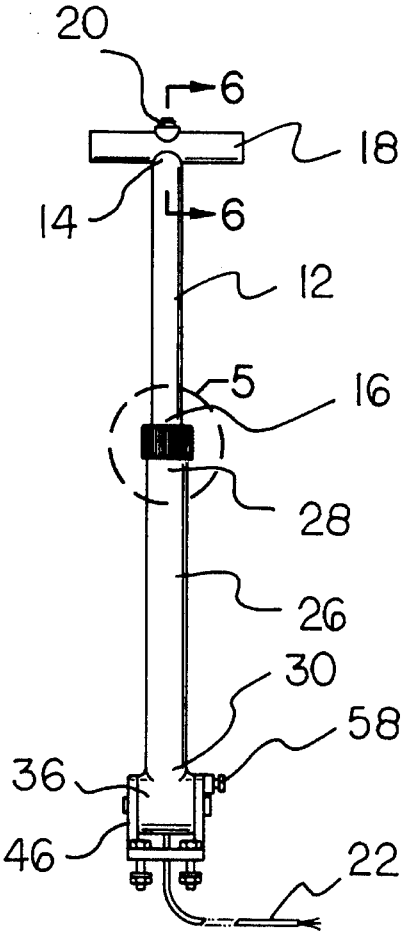
FIG. 2 is a side elevation view of the present invention.
Figure 3:
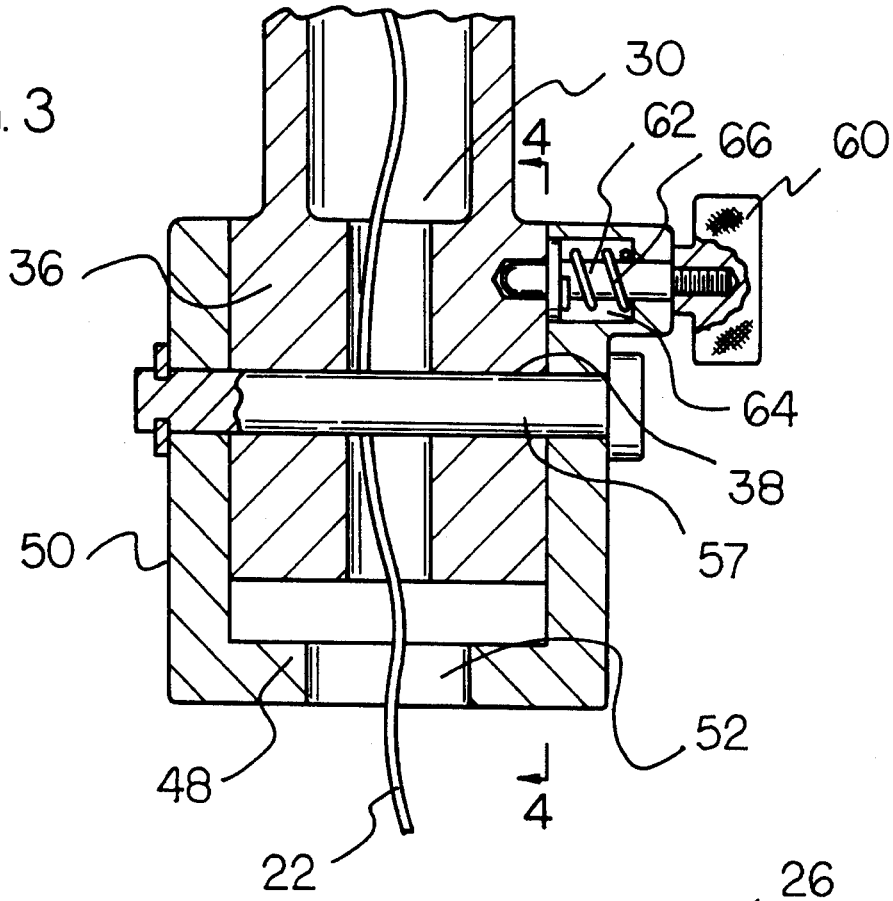
FIG. 3 is a cross-sectional view of the pivotal coupling of the lower shaft to the mounting base.
Figure 4:
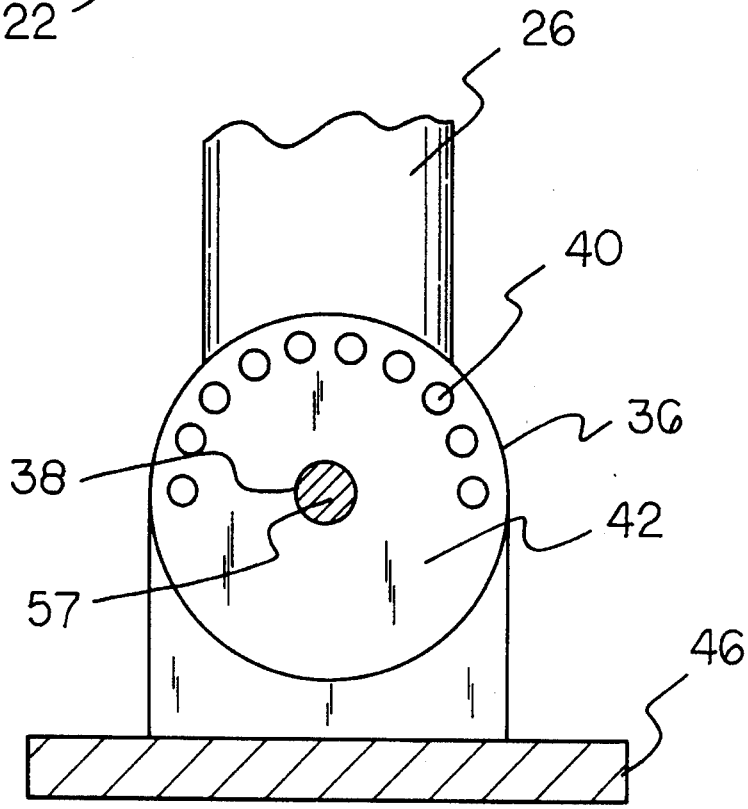
FIG. 4 is a cross-sectional view as taken along line 4–4 of FIG. 3.
Figure 5:
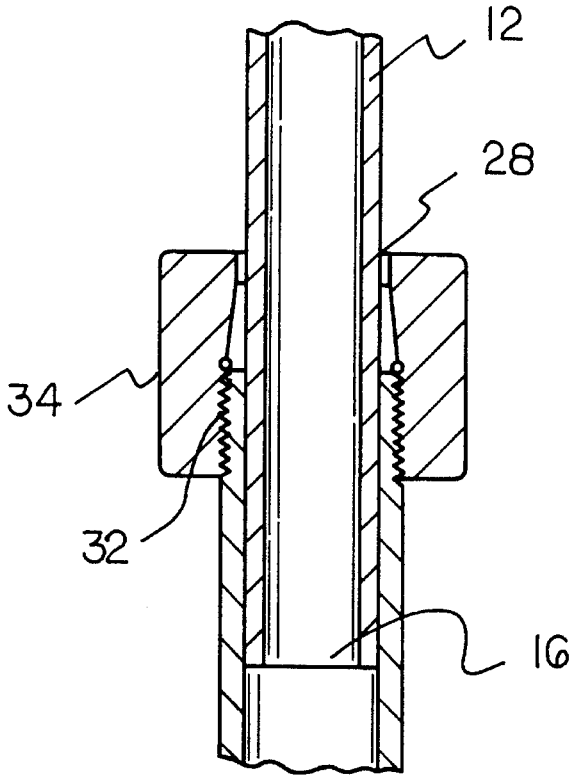
FIG. 5 is a sectional view of the upper shaft coupled with the lower shaft.
Figure 6:
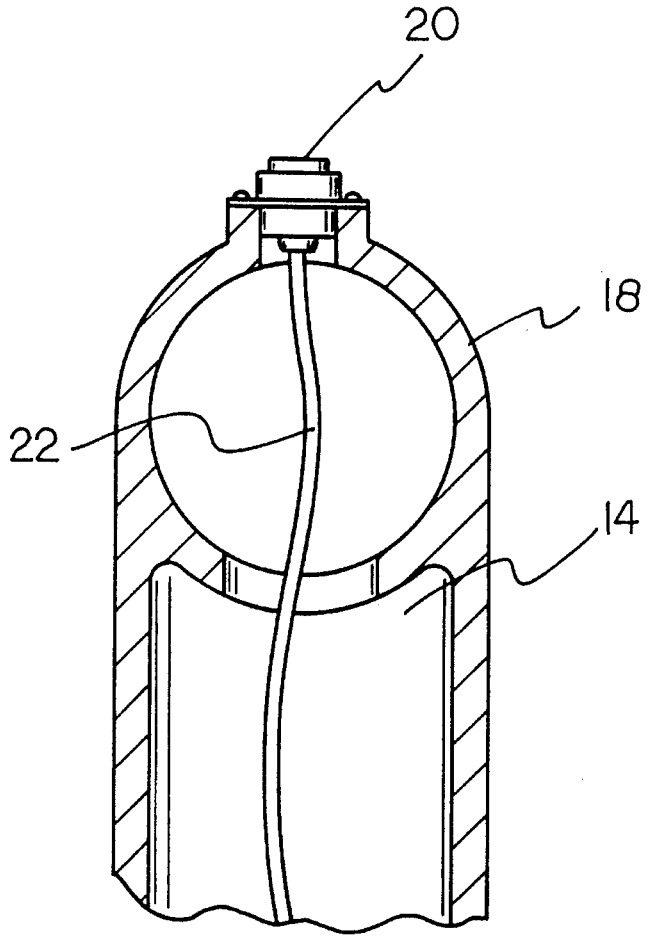
FIG. 6 is a cross-sectional view as taken along line 6–6 of FIG. 2.

With reference now to the drawings, and in particular, to FIGS. 1–6 thereof, the preferred embodiment of the new and improved attachment for hand control of a foot operated controller for an electric trolling motor embodying the principles and concepts of the present invention and generally designated by the reference number 10 will be described.

Specifically, it will be noted in the various Figures that the device relates to a new and improved attachment for hand control of a foot operated controller for an electric trolling motor for allowing a user to use their hands to control an electric trolling motor. In its broadest context, the device consists of a tubular upper handle, a tubular lower handle, and a U-shaped securement bracket.

The first component is a tubular upper handle 12 having an open first end 14 and an open second end 16. The open first end 14 has a grasping handle 18 secured orthogonally thereto. The grasping handle 18 has a control mechanism 20 on an upper portion thereof. The control mechanism is a push-button utilized for activation and deactivation of the device 10. The control mechanism 20 has wiring 22 extending downwardly therefrom outwardly of the open second end 16.

The next component is a tubular lower handle 26 having an open first end 28 and an open second end 30. The tubular lower handle 26 is of a similar length as the tubular upper handle 12. The open first end 28 has external threads 32 thereon. The open first end 28 telescopically receives the open second end 16 of the tubular upper handle 12 therein. The open first end 28 has an adjustment nut 34 thereon cooperating with the external threads 30 thereof for adjustable securement of the tubular upper handle 12 within the tubular lower handle 26. A user would simply unscrew the adjustment nut 34 to allow the tubular upper handle 12 to slide up and down within the tubular lower handle 26 to position the grasping handle 18 at a desired height that is comfortable for the user to manipulate. The open second end 30 of the tubular lower handle 26 has a securement portion 36 integral therewith. The securement portion 36 has an aperture 38 formed horizontally therethrough. The securement portion 36 has a plurality of female detent elements 40 formed on a side 42 thereof positioned in a semi-circular arrangement above the aperture 38 formed therethrough. The side 42 of the securement portion 36 is planar and circular in shape. The wire 22 from the control mechanism 20 of the tubular upper handle 12 extends outwardly of the open second end 30 of the tubular lower handle 26.

The final component is a U-shaped securement bracket 46 having a lower portion 48 and two upper portions 50. The lower portion 48 has an aperture 52 formed therethrough. The lower portion 48 is secured to a foot operated controller 54 for an electric trolling motor 56. The preferred securement of the lower portion 48 to the foot operated controller 54 is by four nuts and bolts through corners thereof. The wire 22 from the control mechanism 20 of the upper tubular handle 12 extends through the aperture 52 in the lower portion 48 for electrical coupling with the foot operated controller 54. The U-shaped securement bracket 46 receives the securement portion 36 of the lower tubular handle 26 between the two upper portions 50 and pivotally couples the securement portion 36 to the two upper portions 50 by a pivot pin 57 extending through the two upper portions 50 and the aperture 38 formed horizontally through the securement portion 36. One of the two upper portions 50 has a spring biased male detent element 58 coupled thereto. The spring biased male detent element 58 selectively cooperates with one of the plurality of female detent elements 40 of the securement portion 36 to adjust the angle of the tubular lower handle 26 in relationship to the U-shaped securement bracket 46 and the foot operated controller 54. The spring biased male detent element 58 consists of an outer knob 60 with a shaft 62 extending through the upper portion 50 to engage one of the plurality of female detent elements 40 of the securement portion. The upper portion has a chamber 64 formed therein where the shaft 62 extends through. A spring 66 is situated within the chamber 64 to bias the shaft 62 inwardly to engage one of the plurality of female detent elements 40.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An attachment for hand control of a foot operated controller for an electric trolling motor for allowing a user to use their hands to control an electric trolling motor comprising, in combination:

a tubular upper handle having an open first end and an open second end, the open first end having a grasping handle secured orthogonally thereto, the grasping handle having a control mechanism on an upper portion thereof, the control mechanism having wiring extending downwardly therefrom outwardly of the open second end;

a tubular lower handle having an open first end and an open second end, the open first end having external threads thereon, the open first end telescopically receiving the open second end of the tubular upper handle therein, the open first end having an adjustment nut thereon cooperating with the external threads thereof for adjustable securement of the tubular upper handle within the tubular lower handle, the open second end of the tubular lower handle having a circular securement portion integral therewith, the circular securement portion having an aperture formed horizontally therethrough, the circular securement portion having a plurality of female detent elements formed on a side thereof positioned in a semi-circular arrangement above the aperture formed therethrough, the wire from the control mechanism of the upper tubular handle extending outwardly of the open second end;

a U-shaped securement bracket having a lower portion and two upper portions, the lower portion having an aperture formed therethrough, the lower portion secured to a foot operated controller for an electric trolling motor, the wire from the control mechanism of the upper tubular handle extending through the aperture in the lower portion for electrical coupling with the foot operated controller, the U-shaped securement bracket receiving the circular securement portion of the lower tubular handle between the two upper brackets and pivotally coupling the circular securement portion to the two upper brackets by a pivot pin extending through the two upper portions and the aperture formed horizontally through the circular securement portion, one of the two upper portions having a spring biased male detent element coupled thereto, the spring biased male detent element selectively cooperating with one of the plurality of female detent elements of the circular securement portion to adjust the angle of the tubular lower handle in relationship to the U-shaped securement bracket and the foot operated controller.

* * * * *